US005851357A

United States Patent [19]

Casale

[11] Patent Number: 5,851,357

[45] Date of Patent: Dec. 22, 1998

[54] COMBINATION SAVEALL AND BLOWBOX SYSTEM

[75] Inventor: Niel C. Casale, Knoxville, Tenn.

[73] Assignee: Valmet, Inc., Charlotte, N.C.

[21] Appl. No.: 796,719

[22] Filed: Mar. 3, 1997

[51] Int. Cl.[6] ..... D21F 7/00

[52] U.S. Cl. ..... 162/272; 162/305; 162/264; 162/199

[58] Field of Search ..... 162/264, 363, 162/202, 305, 306, 290, 193, 199, 272, DIG. 7; 100/173, 174, 175; 34/114, 116, 117, 120, 122, 123; 226/973

[56] References Cited

U.S. PATENT DOCUMENTS

| | | | |
|---|---|---|---|
| 4,074,841 | 2/1978 | Kramer et al. | 226/97.3 |
| 4,116,763 | 9/1978 | Stotz et al. | 162/301 |
| 4,308,984 | 1/1982 | Vits | 226/97.3 |
| 4,628,618 | 12/1986 | Virta et al. | 34/116 |
| 4,698,919 | 10/1987 | Wedel | 34/117 |
| 4,856,205 | 8/1989 | Meyer et al. | 34/117 |
| 5,647,958 | 7/1997 | Schmidt-Rohr et al. | 162/203 |

*Primary Examiner*—Peter Chin
*Assistant Examiner*—Jose Fortuna
*Attorney, Agent, or Firm*—Michael E. McKee

[57] ABSTRACT

A combination blowbox/saveall system (20) and method for use in conjunction with a pick-up roll (22) of a papermachine (18) around which a carrier fabric (26) and running web (28) are moved in concert utilizes a blowbox section (40) for directing air from a source generally away from the surface of the carrier fabric opposite the web to reduce the likelihood of separation of the web from the carrier fabric and a saveall section (60) joined to the blowbox section in a single device. During operation of the system, at least a portion of the air which is directed away from the carrier fabric by the blowbox section for the purpose of preventing separation of the web and fabric downstream of the pick-up roll is used to dislodge water droplets (72) and other contaminants from the surface of the pick-up roll, and these droplets and contaminants are collected within the saveall section for disposal.

13 Claims, 1 Drawing Sheet

COMBINATION SAVEALL AND BLOWBOX SYSTEM

BACKGROUND OF THE INVENTION

This invention relates generally to papermachines used in the making of paper and relates, more particularly, to the means and methods for preventing separation of a web of paper from a carrier fabric following the passage of the carrier fabric and web around the surface of a cylindrical roll, such as a pick-up roll, of a papermachine.

It is known that a blowbox can be utilized to reduce the likelihood of separation of a running web of paper from a carrier fabric as the carrier fabric and web move off of the surface of a pick-up roll. In this regard, a blowbox can be positioned adjacent the off-running side of the pick-up roll for directing air from a source generally away from the surface of the carrier fabric on the side thereof opposite the running web to create a vacuum zone on the fabric-side of the fabric and web arrangement. The resulting difference in air pressure between the web side and the fabric side of the fabric and web arrangement biases the web against the carrier fabric and helps to prevent separation of the web and fabric from one another as the carrier fabric and web are moved past this vacuum zone. Examples of blowboxes used for altering the air pressure adjacent selected regions of a carrier fabric and running web moving through a papermachine are shown and described in U.S. Pat. Nos. 4,516,330, 4,628,618 and 4,551,203.

Commonly, the air which is directed out of a blowbox for the purpose of creating a vacuum zone at a selected region is discharged from the environment of the papermachine before additional benefits are obtained from the air. It would be desirable to obtain additional work from the air which is directed out of a blowbox before the air is discharged from the papermachine environment.

Accordingly, it is an object of the present invention to provide a new and improved means for obtaining additional benefits from the air which is directed from a blowbox and an associated method.

Another object of the present invention to provide such a means which utilizes air which is directed out of a blowbox for conditioning the surface of a pick-up roll following the passage therearound of a carrier fabric and web.

Still another object of the present invention is to provide such a means which utilizes air which is directed out of a blowbox for removing water from the surface of a pick-up roll following the passage therearound of a carrier web and web by dislodging water droplets and other contaminants from the surface of the pick-up roll.

A further object of the present invention is to provide such means which collects water droplets and other contaminants which are dislodged from the surface of the pick-up roll for disposal.

A still further object of the present invention is to provide such means which is uncomplicated in construction, yet effective in operation.

SUMMARY OF THE INVENTION

This invention resides in a system and method for use on the off-running side of a pick-up roll of a papermachine around which a carrier fabric and paper web are moved wherein the carrier fabric is disposed between the web and the surface of the pick-up roll.

The system of the invention includes a blowbox section positionable adjacent the pick-up roll on the off-running side thereof for directing air from a source away from the surface of the carrier fabric opposite the web to reduce the likelihood of separation of the web from the carrier fabric. The means for directing air from the source also directs at least a portion of the air generally around the surface of the pick-up roll so that water droplets and other contaminants which cling to the surface of the pick-up roll following the movement of the carrier fabric and web off of the off-running side of the roll are dislodged from the surface of the roll by the directed air portion. The system also includes a saveall section associated with the blowbox section including means for collecting the water droplets and other contaminants which are dislodged from the surface of the pick-up roll by the directed air portion.

The method of the invention includes the steps involved in using the aforedescribed system of the invention. In particular, a vacuum zone is created adjacent the surface of the carrier fabric on the side thereof opposite the web and adjacent the off-running side of the pick-up roll by directing air generally away from the surface the carrier fabric, and then utilizing at least a portion of the air which is directed generally away from the surface of the carrier fabric to dislodge water droplets and other contaminants from the surface of the pick-up roll. The droplets and contaminants which are dislodged from the surface of the pick-up roll by the utilized portion of the air are subsequently collected for disposal.

DETAILED DESCRIPTION OF AN ILLUSTRATIVE EMBODIMENT

Figure 1:
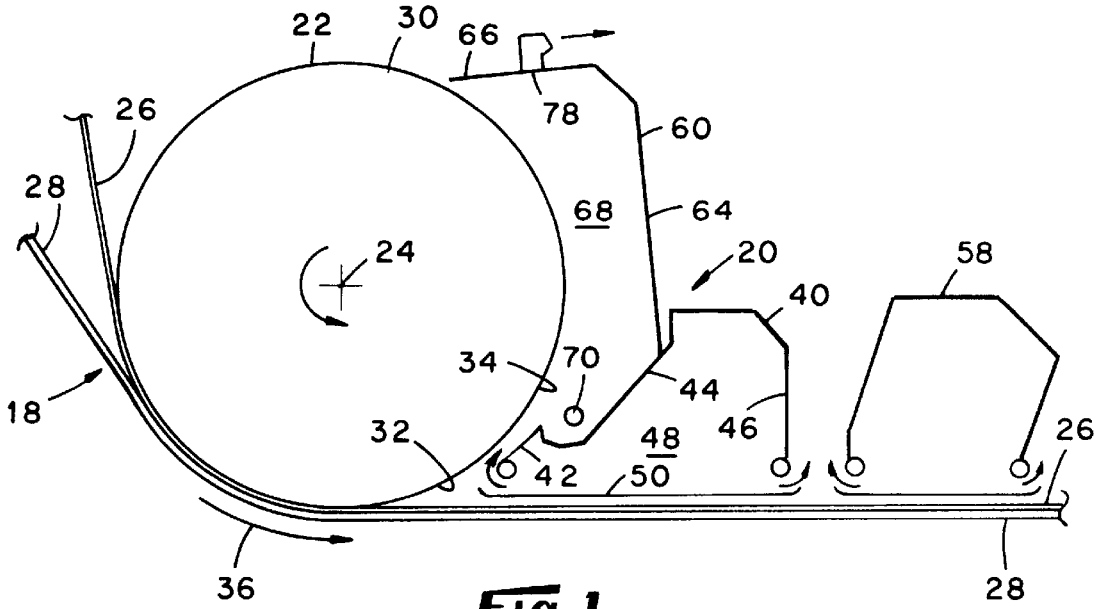
FIG. 1 is a schematic side view of a fragment of a pick-up section of a paper machine within which an embodiment of a combination blowbox/saveall system is incorporated.

Turning now to the drawings in greater detail, there is shown in FIG. 1 an environment within which an embodiment, generally indicated 20, of a combination blowbox/saveall system is utilized. More specifically, the depicted environment includes a pick-up section of a papermachine 18 having a cylindrical pick-up roll 22 mounted for rotation about an axis 24 (e.g. for counterclockwise rotation about the axis 24 as viewed in FIG. 1) and further includes a carrier fabric 26 and a running web 28 which are moved into engagement with one another and around the roll 22 in the direction of the arrow 36 during the rotation of the roll 22. The pick-up roll 22 has a peripheral surface 30 comprised, for example, of stainless steel, and which may (or may not) be perforated and employ vacuum or vacuum-enhanced sections to help transfer the web 28 to the fabric 26. By comparison, the carrier fabric 26 is comprised of a soft, air-permeable material, such as felt, which is adapted to engage the web 28 as the web 28 is guided around the roll surface 30. In the illustrated fragment of the depicted paper machine 18, the fabric 26 is disposed between the web 28 and the roll surface 30 as the fabric and web are moved together onto and then off of the roll surface 30.

The side, indicated 34, of the pick-up roll 22 off of which the web 28 and fabric 26 are moved is referred to herein as the "off-running side" of the roll 22 to differentiate this side of the roll 22 from the side thereof onto which the web 28 and fabric 26 are moved. The region of airspace provided between the roll surface 30 and the carrier fabric 26 on the off-running side of the roll 22 is commonly referred to as a nip 32, and as will be apparent herein, the combination blowbox/saveall system 20 is disposed adjacent this nip 32 for the dual purpose of preventing separation of the web 28 from the fabric 26 as the web and fabric are moved off of the roll surface 30 and for collecting water droplets and other contaminants which are dislodged from the surface 30 of the roll 22 (in a manner described herein) following the movement of the fabric 26 and web 28 off of the roll surface 30.

Figure 2:
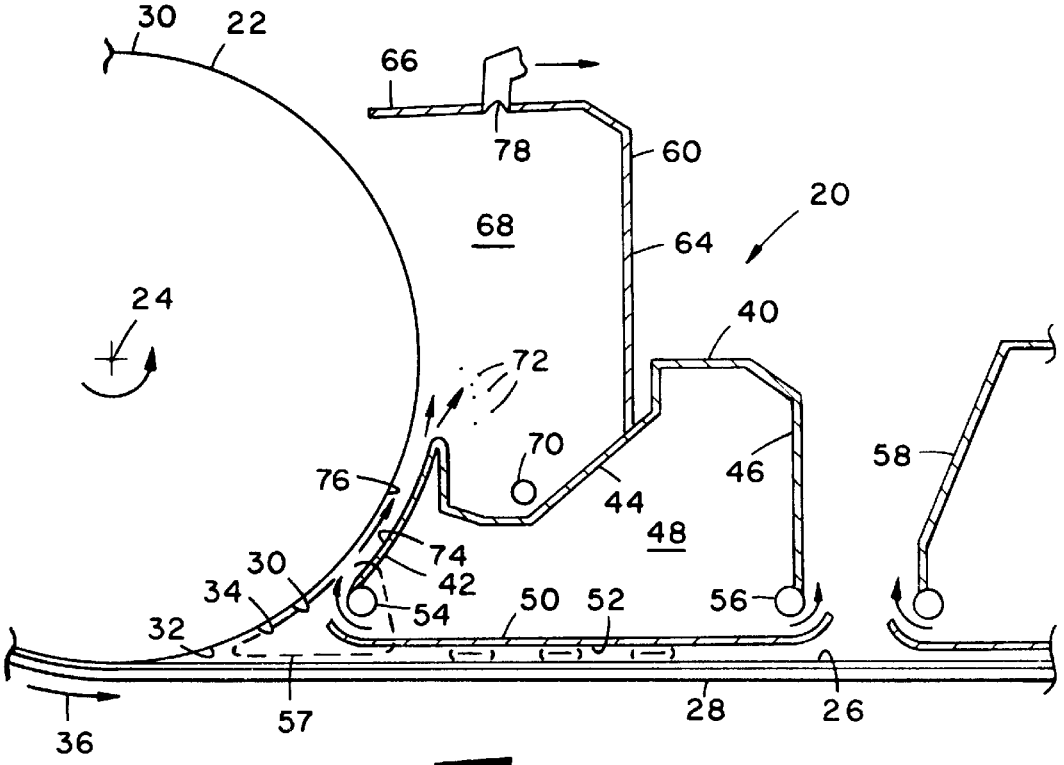
FIG. 2 is a view similar to that of FIG. 1 of the FIG. 1 fragment, but drawn to a slightly larger scale.

With reference still to FIG. 1, the system 20 includes a blowbox section 40 situated adjacent the off-running side of the roll 22 and disposed adjacent the carrier fabric 26 on the side thereof opposite the web 28. As best shown in FIG. 2, the blowbox section 40 includes a series of walls 42, 44, 46 which are joined together to provide an interior 48 for the blowbox section 40 and also includes a partition 50 which separates the blowbox interior 48 from the fabric 26. Each of the walls and partition 50 of the blowbox section 40 are constructed, for example, of appropriately-shaped sheet metal, and the interior 48 is sized to span substantially the entire width of the fabric 26. The partition 50 of the blowbox section 40 is arranged generally parallel to the surface of the fabric 26 for an appreciable distance therearound so a narrow air space 52 (best shown in FIG. 2) is provided between the partition 50 and the upper surface of the fabric 26. Nozzles 54 and 56 are disposed at the opposite (longitudinal) ends of the blowbox interior 48 for receiving pressurized air from an air supply (e.g. a high-pressure industrial fan) and for discharging the air through elongated slots formed along the length of the nozzles 54 or 56. A pair of nip plates 57 (only one shown in phantom in FIG. 2) are mounted upon the blowbox section 40 at the opposite ends of the pick-up roll 22 to separate and seal the nip 32 from the regions of airspace situated outboard of the roll 22.

The operating principles of the blowbox section 40 are well known so that a detailed description of such principles are not believed to be necessary. Suffice it to say that as streams of air are discharged from the nozzles 54 and 56 in directions generally away from the upper surface of the fabric 26, a vacuum zone (i.e. a region of sub-atmospheric pressure) is created within the air space 52. The resulting difference in air pressure which exists between the air space 52 and the air space disposed on the side of the web 28 opposite the fabric 26 (i.e. between the air space regions defined above and below the fabric 26 and web 28 as shown in FIG. 2) biases the web 28 upwardly against the downwardly-facing surface of the fabric 26 and thereby helps to prevent a separation between the web 28 and the fabric 26 as the web and fabric move off of the roll surface 30. Thus, the blowbox section 40 of the system 20 reduces the likelihood that the web 28 will separate from the carrier fabric 26 as the web 28 and fabric 26 move off of the roll surface 30, and the blowbox section 40 is advantageous in this respect.

In the depicted environment, the fabric 26 and web 28 move for a relatively lengthy distance from the moment that they move past the blowbox section 40 until they move onto the surface of a subsequent roll (not shown) located, for example, in a press section. To prevent separation of the fabric 26 and web 28 during this lengthy run downstream of the blowbox section 40, one or more additional blowboxes 58 (only one shown in FIGS. 1 and 2) can be positioned adjacent the surface of the fabric 26 at a location situated downstream of the blowbox section 40. It will be understood, however, that these additional blowboxes 58 are optional and probably would not be needed if the run of the fabric 26 and web 28 which extends between two adjacent rolls was relatively short.

With reference still to FIG. 2, the system 20 also includes a saveall section 60 which is joined to the blowbox section 40 in a single device. The saveall section 60 includes an open receptacle 68 which is positioned in such a relation to the pick-up roll 22 so as to open generally toward the surface 30 of the roll 22. To this end, the receptacle 68 depicted in FIG. 2 is provided by top and back walls 66 and 64, respectively, and shares a wall 44 with the blowbox section 40 wherein this shared wall 44 provides a bottom for the receptacle 68. As best shown in FIG. 2, the receptacle 68 of the saveall section 60 extends for a substantial distance around the periphery of the roll surface 30.

Since the fabric 26 and web 28 are both relatively wet as they move in concert through a substantial portion of the pick-up section of the papermachine 18, it is not uncommon that the surface 30 of the roll 22 will become wet with water in the form of droplets 72 (FIG. 2) or other contaminants from the fabric 26 and web 28 as the fabric 26 and web 28 move around a portion of the roll surface 30. Furthermore, in the instance in which the roll surface is perforated, these water droplets and contaminants can cover the openings of the perforations and become detrimental to the operation of an attending vacuum-enhanced section of the roll. As will be explained herein, these water droplets 72 and contaminants are dislodged from the surface 30 of the roll 22 and are collected within the receptacle 68 of the saveall section 60. Associated with the receptacle 68 is a drain 70 which accommodates the evacuation and disposal of water and contaminants which have been collected within the receptacle 68.

It is a feature of the system 20 that at least a portion of the air which is used by the blowbox section 40 for the purpose of creating a vacuum zone within the air space 52 is also used to dislodge water droplets 72 and contaminants from the surface 30 of the roll 22. To this end, the wall 42 of the blowbox section 40 of the system 20 includes a partition surface 74 which is disposed generally parallel to the surface 30 of the roll 22 for an appreciable distance along the off-running side 34 of the roll 22. This partition surface 74 provides, along with the adjacent fragment of the surface 30 of the roll 22, an air channel 76 through which air is conducted along the roll surface 30 as it leaves the blowbox section nozzle 54. It will be understood that air is directed through the channel 76 substantially tangentially around the roll surface 30 in a direction which corresponds with the direction of movement of the pick-up roll 22 past the channel 76. It will also be understood, however, that the velocity of the air which exits the nozzle 54 is much greater than the velocity of the surface 30 of the roll 22 past the channel 76 (and preferably is at least about one and one half times greater than the speed of the roll surface). In addition, an exhaust 78 can be provided in one wall 66 of the saveall section 60 through which air is permitted to escape therefrom.

As the high-velocity air is forced through the channel 76 by the blowbox nozzle 54, the air moves along the surface 30 of the roll 22 in a manner which sweeps and scrubs the roll surface 30 and strips (thereby dislodging) water droplets and other contaminants from the surface 30. The water droplets 72 and contaminants which are dislodged from the roll surface 30 exit the channel 76 with the air, yet are confined within the cavity encompassed by the walls 44, 64, 66 of the receptacle 68 so as to be prevented from being blown back or fall back onto the surfaces of the web 28 and fabric 26 situated downstream of the off-running side 34 of the roll 22. Instead, the dislodged droplets and contaminants are collected within the receptacle 68 of the saveall section 60 and are permitted to migrate gravitationally to the bottom of the receptacle 68 for removal through the drain 70.

Exemplary dimensions of the illustrated combination saveall/blowbox system 20 for use adjacent a pick-up roll 22 having a diameter of about three feet, eleven inches are provided here as follows: The entrance to the channel 76 is spaced about four inches from the upper surface of the fabric 26; the length of the channel 76 as measured between its entrance and exit is about six inches; and the receptacle 68 of the saveall section 60 extends around about one-fourth of the circumference of the pick-up roll 22.

It follows from the foregoing that a combination blowbox/saveall system 20 has been described which serves the dual function of reducing the likelihood of separation of the web 28 from its carrier fabric 26 downstream of the off-running side 34 of a pick-up roll 22 and for dislodging water droplets and contaminants from the surface 30 of the roll 22 for collection and disposal following the passage therearound of the fabric 26 and web 28. Moreover, a method has been described which utilizes a portion of the stream of air used for preventing the separation of a web 28 from a carrier fabric 26 following the movement of the carrier fabric and web around the surface of the pick-up roll 22 for dislodging water droplets and other contaminants which cling to the surface 30 of the pick-up roll 22 following the movement therearound of the carrier fabric 26 and web 28. By utilizing the blowbox-generated air to scrub and thereby dislodge water droplets and contaminants from the surface of the pick-up roll 22, additional benefits are obtained from the blowbox-generated air before the air is discharged from the papermachine environment.

It will be understood that numerous modifications and substitutions can be had to the aforedescribed embodiment without departing from the spirit of the invention. For example, although the aforedescribed system 20 has been shown and described as including a blowbox section 40 and a saveall section 60 which share at least one common wall, the blowbox and saveall sections of a system in accordance with the broader aspects of the present invention may not share any common walls. As a practical matter, however, in order for the saveall section to collect water and contaminants which have been dislodged by the blowbox-generated air, the saveall section and the blowbox section are likely to be situated relatively close to one another. Still further, although the aforedescribed system 20 has been shown and described as including a saveall section 60 which is disposed generally above the blowbox section 40, the saveall and blowbox sections of an alternative system can possess an alternative disposition.

Further still, although the aforedescribed system 20 has been described for use in conjunction with a roll 22 of a pick-up section of a papermachine, a system in accordance with the present invention can be utilized downstream of other rolls of a papermachine, such as those situated within the press section of a papermachine. Along these lines, it is believed that a system in accordance with the present invention can be advantageously employed downstream of a roll wherein the run of the fabric and web between adjacent rolls is long enough that separation of the web and fabric from one another is likely and wherein the percentage of water within the paper web is within the range of about sixty to eighty-five percent so that the surface of the roll is wetted appreciably by the passage of the fabric and web therearound.

Accordingly, the aforedescribed embodiment is intended for the purpose of illustration and not as limitation.

I claim:

1. A system adjacent a roll of a papermachine around which a carrier fabric and web are moved together wherein the carrier fabric is disposed between the web and the surface of the roll and wherein the roll has an off-running side off of which the carrier fabric and web move from the roll, the system comprising:

a blowbox section positionable adjacent the roll on the off-running side thereof including means for directing source air away from the surface of the carrier fabric opposite the web to reduce separation of the web from the carrier fabric and including a partition which provides, with the surface of the roll, an air channel which extends along the surface of the roll and wherein the means for directing source air directs at least a portion of the air through the provided air channel so that water droplets and other contaminants which cling to the surface of the roll following the movement of the carrier fabric and web off of the off-running side of the roll are dislodged from the surface of the roll by the directed air portion; and a saveall section joined to the blowbox section and including means for collecting the water droplets and other contaminants which are dislodged from the surface of the roll by the directed air portion.

2. The system as defined in claim 1 wherein the blowbox section includes a nozzle out of which source air is directed away from the surface of the carrier fabric, and the system further includes means joined to the saveall section for routing air which is directed out of said nozzle tangentially around the surface of the roll and in a direction therearound which corresponds to the direction of movement of the roll surface.

3. The system as defined in claim 2 wherein the blowbox section includes means for directing air out of said nozzle at a velocity which is greater than that of the roll surface.

4. The system as defined in claim 1 wherein the saveall section of the system includes means providing a cavity disposed downstream of the directed portion of air within which water droplets and contaminants are collected, and said cavity includes a lower section into which the collected water droplets and contaminants are permitted to gravitationally migrate.

5. The system as defined in claim 4 further including a drain joined to the lower section of the cavity-providing means through which the collected water droplets and contaminants can be drained from the saveall section.

6. The system as defined in claim 1 wherein the saveall section is disposed above the blowbox section in the system.

7. A combination blowbox and saveall system in conjunction with a roll of a papermachine wherein a running web and carrier fabric are moved around and off the roll and wherein the carrier fabric is disposed between the web and the surface of the roll as the web and carrier fabric are moved around the roll and wherein the roll has an off-running side off of which the web and carrier fabric move from the roll, the system comprising:

a blowbox section including means for directing source air away from the surface of the carrier fabric on the side thereof opposite the running web to reduce separation of the web from the carrier fabric adjacent the off-running side of the roll and including a partition which provides, with the surface of the roll, an air channel which extends along the surface of the roll and wherein the means for directing source air directs at least a portion of the air through the provided air channel so that droplets of water which cling to the surface of the roll following the movement of the web and carrier fabric off of the off-running side of the roll are stripped from the surface of the roll by said portion of air; and a saveall section joined to the blowbox section including means for collecting the droplets of water which are stripped from the roll surface by said portion of air for disposal.

8. The system as defined in claim 7 wherein the blowbox includes a nozzle out of which air is directed from the source away from the surface of the carrier fabric, and the system further includes means joined to the saveall section for routing air which is directed out of said nozzle tangentially around the surface of the roll and in a direction therearound which corresponds to the direction of movement of the roll surface.

9. The system as defined in claim 8 wherein the blowbox section includes means for directing air out of said nozzle at a velocity which is greater than that of the roll surface.

10. The system as defined in claim 8 wherein the blowbox section includes means for directing air out of said nozzle at a velocity which is at least one and one-half times the velocity of the roll surface.

11. The system as defined in claim 7 wherein the saveall section of the system includes means providing a cavity disposed downstream of the directed portion of air within which water droplets and contaminants are collected, and said cavity includes a lower section into which the collected water droplets and contaminants are permitted to gravitationally migrate.

12. The system as defined in claim 11 further including a drain joined to the lower section of the cavity-providing means through which the collected water droplets and contaminants can be drained from the saveall section.

13. The system as defined in claim 7 wherein the saveall section is disposed above the blowbox section in the system.

* * * * *